US006948213B2

(12) United States Patent
Kim

(10) Patent No.: US 6,948,213 B2
(45) Date of Patent: Sep. 27, 2005

(54) VEHICLE FOR SWEEPING STREETS

(76) Inventor: Jongsoon Kim, 605 Cheonggu Apt., 828-3, Mugeo-dong, Nam-gu, Ulsan, 680-809 (KR)

( * ) Notice: Subject to any disclaimer, the term of this patent is extended or adjusted under 35 U.S.C. 154(b) by 417 days.

(21) Appl. No.: 10/138,411

(22) Filed: May 6, 2002

(65) Prior Publication Data

US 2003/0204931 A1 Nov. 6, 2003

(51) Int. Cl.[7] ..... A47L 5/00

(52) U.S. Cl. ..... 15/340.4; 15/320; 15/352; 15/353

(58) Field of Search ..... 15/340.1, 340.2, 15/340.3, 340.4, 320, 347, 352, 353; 55/300

(56) References Cited

U.S. PATENT DOCUMENTS 1,670,934 A * 5/1928 Keefer ..... 15/320
3,011,206 A * 12/1961 Breither ..... 15/320
3,160,908 A * 12/1964 Krier et al. ..... 15/352
4,194,263 A * 3/1980 Herpers et al. ..... 15/353
4,207,647 A * 6/1980 Masters ..... 15/353
4,348,783 A * 9/1982 Swanson et al. ..... 15/320
4,464,810 A * 8/1984 Karpanty ..... 15/320
5,613,270 A * 3/1997 Alvarez et al. ..... 15/320
5,768,742 A * 6/1998 Kohl et al. ..... 15/320
5,901,407 A * 5/1999 Boomgaarden ..... 15/320

* cited by examiner

*Primary Examiner*—Theresa T. Snider
(74) *Attorney, Agent, or Firm*—Bacon & Thomas

(57) ABSTRACT

Disclosed is a street sweeper. The street sweeper includes a water tank, a collection hopper delimiting a refuse accommodating space and having a filtering screen, water spraying nozzles connected to the water tank, brushes positioned close to the street, a refuse suction tube placed adjacent to the brushes, and a blower unit for inducing suction force in the refuse suction tube. The street sweeper is adapted for sucking and collecting refuse existing on the street through the refuse suction tube into the collection hopper while water is sprayed from the water spraying nozzles. An opening is defined through a bottom wall of the collection hopper. A water inlet hole to be communicated with the opening is defined through a wall of the water tank. A filter assembly is arranged between the opening of the collection hopper and the water inlet hole of the water tank.

13 Claims, 6 Drawing Sheets

VEHICLE FOR SWEEPING STREETS

TECHNICAL FIELD

The present invention relates to a vehicle for sweeping streets which is operated through manipulation of levers or switches by a driver riding thereon to dislodge and pick up dirt and debris from a street, expressway, parking lot, industrial complex, landing strip, stadium, etc.

BACKGROUND ART

Recently, with the improvement of living standards, people's concern about environmental beautification is gradually increased. In this regard, since dirt, leaves, gravel and the like (hereinafter, simply referred to as "refuse"), which are scattered on the street, defile the appearance of the street, it is necessary to frequently sweep them up.

If the refuse is introduced into and accumulates in a sewer pipe, the sewer pipe is likely to be clogged by the refuse. As a consequence, flow of sewage is obstructed, and, as a result of this, backflow of sewage may take place. Also, when compared to the case of sweeping refuse on the street, a great deal of costs are incurred upon removing the refuse after introduction thereof into the sewer pipe, whereby economic loss is caused.

It is the norm that street sweeping is conducted at dawn in order not to obstruct traffic flows. In the case that a sanitation engineer manually sweeps the street, a possibility of the sanitation engineer to be exposed to a traffic accident is increased. Therefore, it would be preferable that the sanitation engineer conducts a sweeping task while riding a vehicle which is equipped with a refuse collecting arrangement.

Referring to FIG. 5, there is shown a side view illustrating a construction of a conventional vehicle for sweeping streets. In the conventional vehicle for sweeping streets, as a driver sitting on a driver's seat drives a blower unit 8 and various driving devices by using power generated by an auxiliary engine 6, street sweeping operation is implemented. A blast capacity of the blower unit 8 is set to a high degree so that debris can be picked up irrespective of whether it is dried or wetted.

If an amount of refuse collected in a collection hopper 1 exceeds a predetermined level, hopper dumping operation is implemented in a manner such that the entire collection hopper 1 is tipped to allow contents to slide out from the collection hopper 1, by gravity, into a garbage dump. While implementing the hopper dumping operation, a door 2 provided to a rear wall of the collection hopper 1 is opened.

While the majority of refuse sucked into the collection hopper 1, which is mounted on the vehicle for sweeping streets, falls toward a bottom of the collection hopper 1, fine dust particles do not accumulate on the bottom. Even if it is possible to collect using a dust separator, the fine dust particles contained in an air stream, since a conventional dust collector generally has a large size, it is difficult to practically install in practice the large-sized dust collector on the vehicle for sweeping streets. Hence, in the conventional vehicle for sweeping streets, a filtering screen 3 is placed on a top of the collection hopper 1 so that the air stream is directed toward the blower unit 8 after passing through the filtering screen 3. Circulation of the air stream is effected by the blower unit 8.

However, a filtering effect accomplished by the filtering screen 3 is so poor that a substantial amount of fine dust particles are exhausted to the atmosphere as they are. These fine dust particles exhausted to the atmosphere cause environmental pollution and reduce visibility to thereby increase a probability of occurrence of traffic accidents.

From this point of view, street sweeping operation is implemented while water is sprayed with a view of preventing fine dust particles from rising and improving a refuse collecting efficiency. Nevertheless, in the wet type street sweeping operation, which is implemented while spraying water, since a volume of a water tank 4 is limited, it is impossible to implement the street sweeping operation for an extended period of time. And, if water filled in the water tank 4 is depleted, the vehicle for sweeping streets must necessarily return to a base place to be refilled with water and then again implement the street sweeping operation.

As can be seen from FIG. 5, due to the fact that the filtering screen 3 is placed on the top of the collection hopper 1, debris sucked into the collection hopper 1 falls toward the bottom thereof and the air stream flows toward the blower unit 8 after passing through the filtering screen 3. Of course, the collection hopper 1 and the water tank 4 are defined separately from each other.

When conducting the wet type street sweeping operation, debris, that is, refuse existing on the street is sucked into the collection hopper 1 along with water which is sprayed on the street from the water tank 4 through nozzles. Consequently, upon completion of the street sweeping operation, water as well as refuse remain in the collection hopper 1. By this fact, a weight of contents of the collection hopper 1 is increased, and water filled in the water tank 4 is quickly depleted to shorten a time of the street sweeping operation.

In the above-mentioned construction of the conventional vehicle for sweeping streets as shown in FIG. 5, the filtering screen 3 is placed on the top of the collection hopper 1, the debris pulled into the collection hopper 1 falls toward the bottom thereof, and the air stream flows toward the blower unit 8 after passing through the filtering screen 3. After being exhausted through the blower unit 8, the air stream containing a substantial amount of fine dust particles is blasted downward onto a pavement. Resultingly, even when conducting the wet type street sweeping operation while spraying water, a filtering effect accomplished by the filtering screen 3 is so insufficient that the fine dust particles contained in the air stream, which is sucked into the collection hopper 1, are exhausted to the atmosphere after passing through the filtering screen 3, to still cause environmental pollution.

Moreover, in the case that the vehicle for sweeping streets travels while not implementing the street sweeping operation, all driving force generated by a main engine of the vehicle for sweeping streets is transmitted to an axle through a differential gear. On the other hand, in the case that the vehicle for sweeping streets travels while implementing the street sweeping operation, the separately provided auxiliary engine 6 must be additionally driven, whereby a weight of the entire vehicle for sweeping streets is increased, and a manufacturing cost and fuel expenses are increased.

DISCLOSURE OF THE INVENTION

Accordingly, the present invention has been made in an effort to solve the problems occurring in the related art, and an object of the present invention is to provide a vehicle for sweeping streets in which water carried in refuse accommodated in a collection hopper is filtered and returned to a water tank to be recycled, to thereby actually maximize a water storage capacity of the vehicle for sweeping streets and lengthen a street sweeping time.

Another object of the present invention is to provide a vehicle for sweeping streets which is provided with a dust collector assembly capable of preventing fine dust particles from being exhausted to the outside.

Still another object of the present invention is to provide a vehicle for sweeping streets which has power distributing means for allowing a blower unit to be driven, via a hydraulic pump, by an engine installed on the vehicle for sweeping streets while not requiring any separate power supply, thereby obviating the need for an auxiliary engine.

Yet still another object of the present invention is to provide a vehicle for sweeping streets which is easy to manufacture and decreased in its weight.

In order to achieve the above objects, according to one aspect of the present invention, there is provided a vehicle for sweeping streets including a vehicular frame, a water tank mounted on the vehicular frame, a collection hopper located above the water tank and defined with a refuse suction port and an air exhaust port, the collection hopper delimiting a refuse accommodating space and having a filtering screen which is arranged in the air exhaust port, water spraying nozzles connected to the water tank to spray water supplied from the water tank on the street, brushes positioned close to the street to be attached to or detached from the street, a refuse suction tube placed adjacent to the brushes to suck and convey refuse on the street through the refuse suction port into the collection hopper, and a blower unit for inducing suction force through the air exhaust port, refuse accommodating space and refuse suction port in the refuse suction tube, the vehicle for sweeping streets adapted for sucking and collecting refuse existing on the street through the refuse suction tube into the collection hopper while water is sprayed from the water spraying nozzles to prevent fine dust particles from rising, wherein an opening is defined through a bottom wall of the collection hopper, a water inlet hole to be connected to the opening through a drain pipe is defined through a wall of the water tank, and a filter assembly is arranged between the opening of the collection hopper and the water inlet hole of the water tank.

According to another aspect of the present invention, the filter assembly comprises at least one water filter and is installed in a filter mounting section which is formed in the opening defined through the bottom wall of the collection hopper; and a drain pipe is arranged between the filter mounting section and the water tank.

According to another aspect of the present invention, the bottom wall of the collection hopper is downwardly inclined toward the opening.

According to another aspect of the present invention, a dust collector assembly for collecting fine dust particles is disposed between the air exhaust port of the collection hopper and the blower unit.

According to another aspect of the present invention, the dust collector assembly for collecting fine dust particles comprises a plurality of air filters which are arranged side by side; and the vehicle for sweeping streets further includes a vibrator for periodically or intermittently vibrating the air filters to remove fine dust particles attached to the air filters and a detachable dust collection tray for collecting removed fine dust particles.

According to another aspect of the present invention, the vehicle for sweeping streets further includes power distributing means for transmitting at least a portion of driving force generated by an engine, to the blower unit through a hydraulic pump.

According to another aspect of the present invention, the power distributing means comprises a hydrostatic gear box.

According to another aspect of the present invention, a dust collector assembly for collecting fine dust particles is disposed between the air exhaust port of the collection hopper and the blower unit.

According to still another aspect of the present invention, the dust collector assembly for collecting fine dust particles comprises a plurality of air filters which are arranged side by side; and the vehicle for sweeping streets further includes a vibrator for periodically or intermittently vibrating the air filters to remove fine dust particles attached to the air filters and a detachable dust collection tray for collecting removed fine dust particles.

According to yet still another aspect of the present invention, an air outlet port of the blower unit is directed toward an upper end of the collection hopper.

BRIEF DESCRIPTION OF THE DRAWINGS

The above objects, and other features and advantages of the present invention will become more apparent after a reading of the following detailed description when taken in conjunction with the drawings, in which:

FIGS. 7*a* and 7*b* are schematic views illustrating power transmitting patterns of a hydrostatic gear box which is applied to the vehicle for sweeping streets according to the present invention to serve as power distributing means, wherein FIG. 7*a* shows a first power transmitting status under a non-sweeping travel condition, and FIG. 7*b* shows a second power transmitting status under a sweeping travel condition of the vehicle for sweeping streets.

BEST MODE FOR CARRYING OUT THE INVENTION

Figure 1:
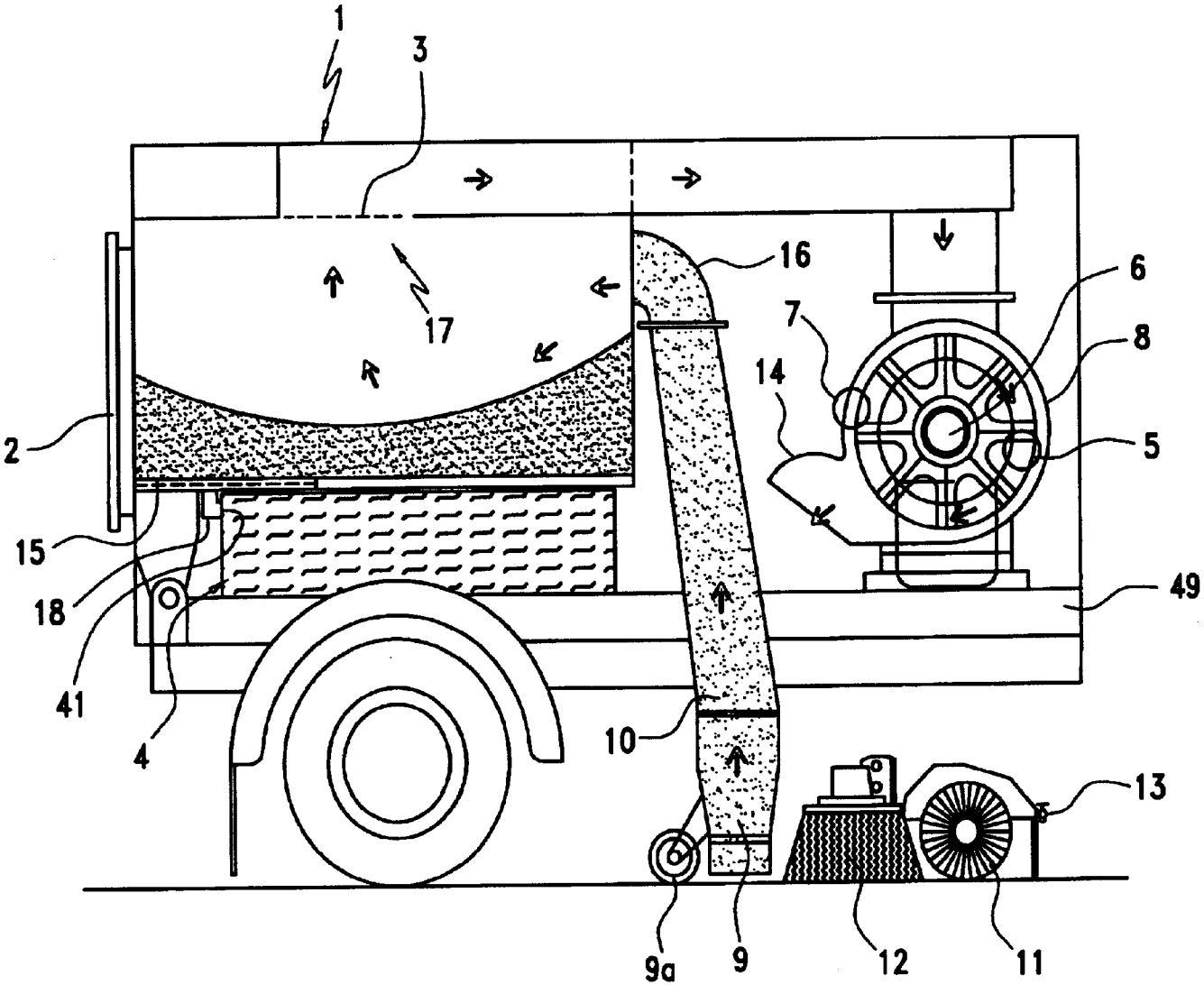
FIG. 1 is a side view illustrating a construction of a vehicle for sweeping streets in accordance with one embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Referring to FIG. 1, there is illustrated a positional relationship between a collection hopper 1 and a water tank 4 mounted on a vehicular frame (49) in a vehicle for sweeping streets in accordance with an embodiment of the present invention. It is to be readily understood from FIG. 1 that a drain pipe 18 is arranged between a bottom wall of the collection hopper 1 and a rear wall of the water tank 4. The water tank 4 is mounted on a vehicular frame 33.

A refuse suction tube 9 is supported by a support roller 9*a* in a manner such that it is positioned at a predetermined separation above the street. The support roller 9*a* is secured to a rear surface of the refuse suction tube 9. Water compressed by a water pump 5 and sprayed by water spraying nozzles 13 wets the street and refuse existing thereon to prevent fine dust particles from rising. As the vehicle for sweeping streets travels forward, the wetted refuse is picked up by a main cylindrical brush 11 and a side brush 12, sucked through the refuse suction tube 9 and then collected in the collection hopper 1 after passing through a refuse suction port 16.

Figure 2:
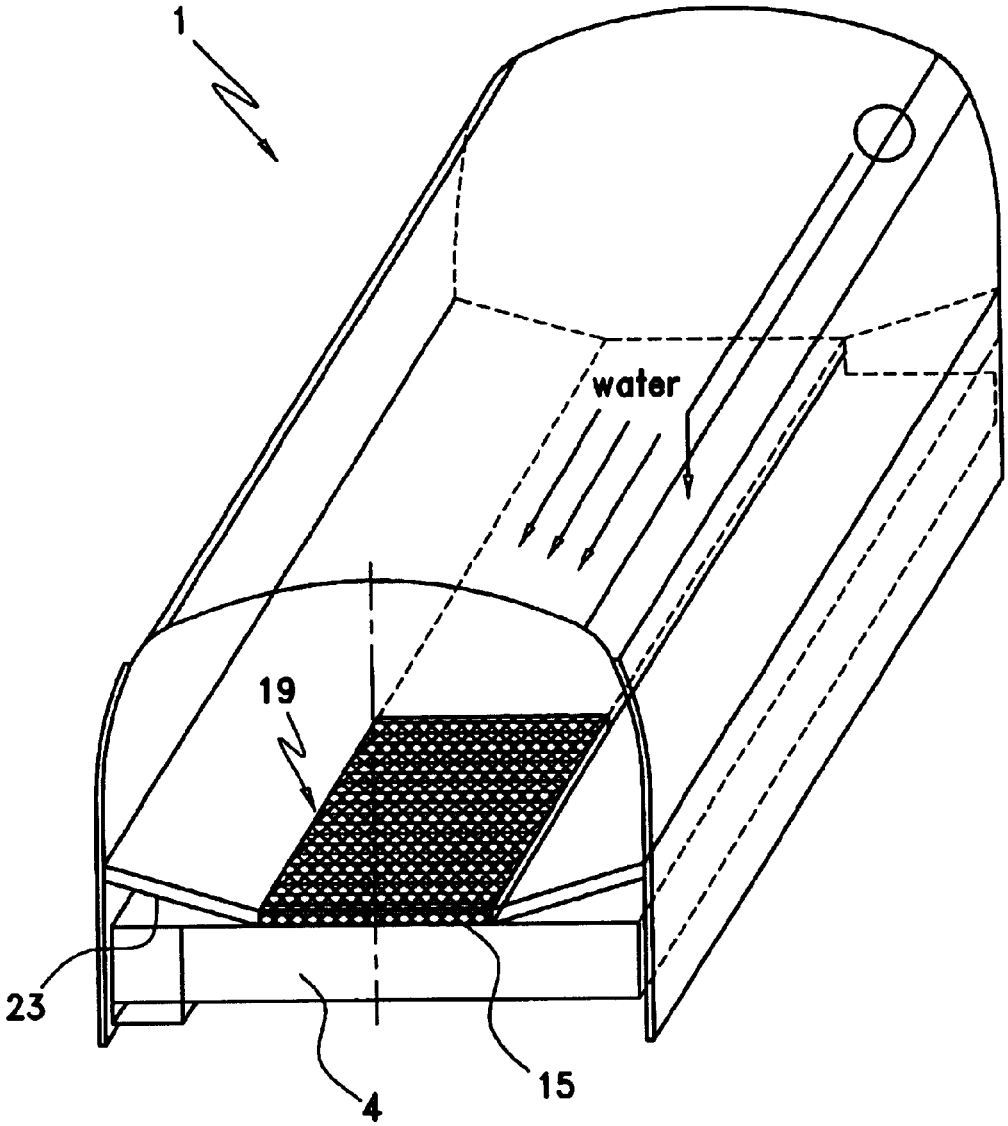
FIG. 2 is a perspective view illustrating an inner structure of a collection hopper loaded on the vehicle for sweeping streets according to the present invention.

A detailed structure of the collection hopper 1 is illustrated in FIG. 2. An opening 19 is defined adjacent to a rear end of the bottom wall of the collection hopper 1, and a filter mounting section is formed in the opening 19. A filter assembly 15 is mounted in the filter mounting section. A water inlet hole 41 is defined adjacent to an upper end of the rear wall of the water tank 4 which is located below the collection hopper 1, to be connected to the inside of the collection hopper 1 trough the drain pipe 18. The drain pipe 18 is arranged between the filter assembly 15 and the water inlet hole 41.

The filter assembly 15 is detachably mounted in the filter mounting section so that the filter assembly 15 can be cleaned after use and maintenance and repair can be easily executed for the filter assembly 15. To this end, the filter assembly 15 is slidingly fitted into the filter mounting section adjacent to the rear end of the bottom wall of the collection hopper 1.

Of course, it can be envisaged that the opening 19 is defined at a center portion of the bottom wall of the collection hopper 1 and the filter assembly 15 is arranged in the opening 19. However, in order to ensure easy access to the filter assembly 15 from the outside for maintenance, repair or cleaning thereof, it is preferred that the filter assembly 15 is located adjacent to the rear end of the bottom wall of the collection hopper 1.

As clearly shown in FIG. 2, the bottom wall of the collection hopper 1 has both side portions 23 and a middle portion which extend in a lengthwise direction of the vehicle for sweeping streets. The middle portion is positioned between both side portions 23. Both side portions 23 of the bottom wall are inclined downward from a front end of the collection hopper 1 toward the opening 19. Due to this fact, when refuse is accumulated on the bottom wall of the collection hopper 1, water carried in the refuse can be reliably returned to the water tank 4 after flowing on the inclined side portions 23 and being filtered by the filtering assembly 15.

Figure 3:
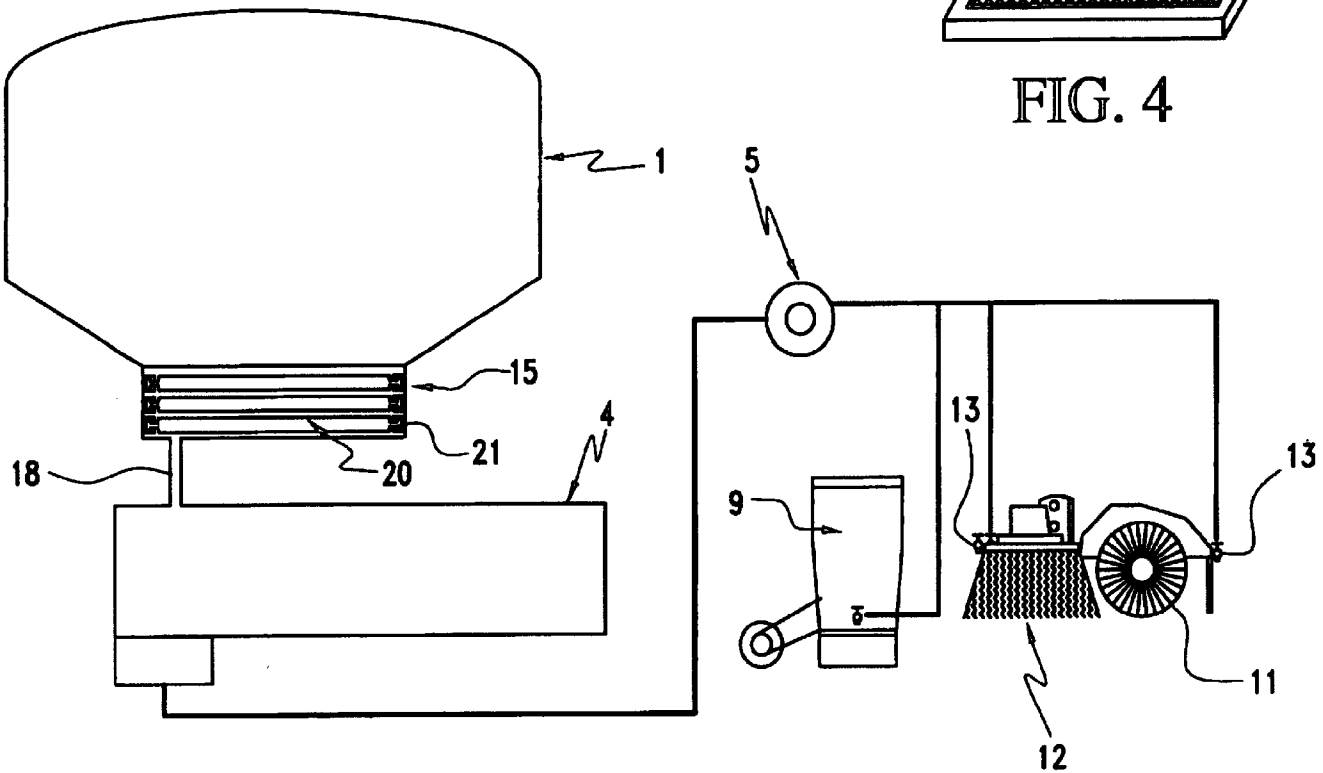
FIG. 3 is a schematic view illustrating a structure of a filter assembly which is used in the vehicle for sweeping streets according to the present invention.
Figure 5:
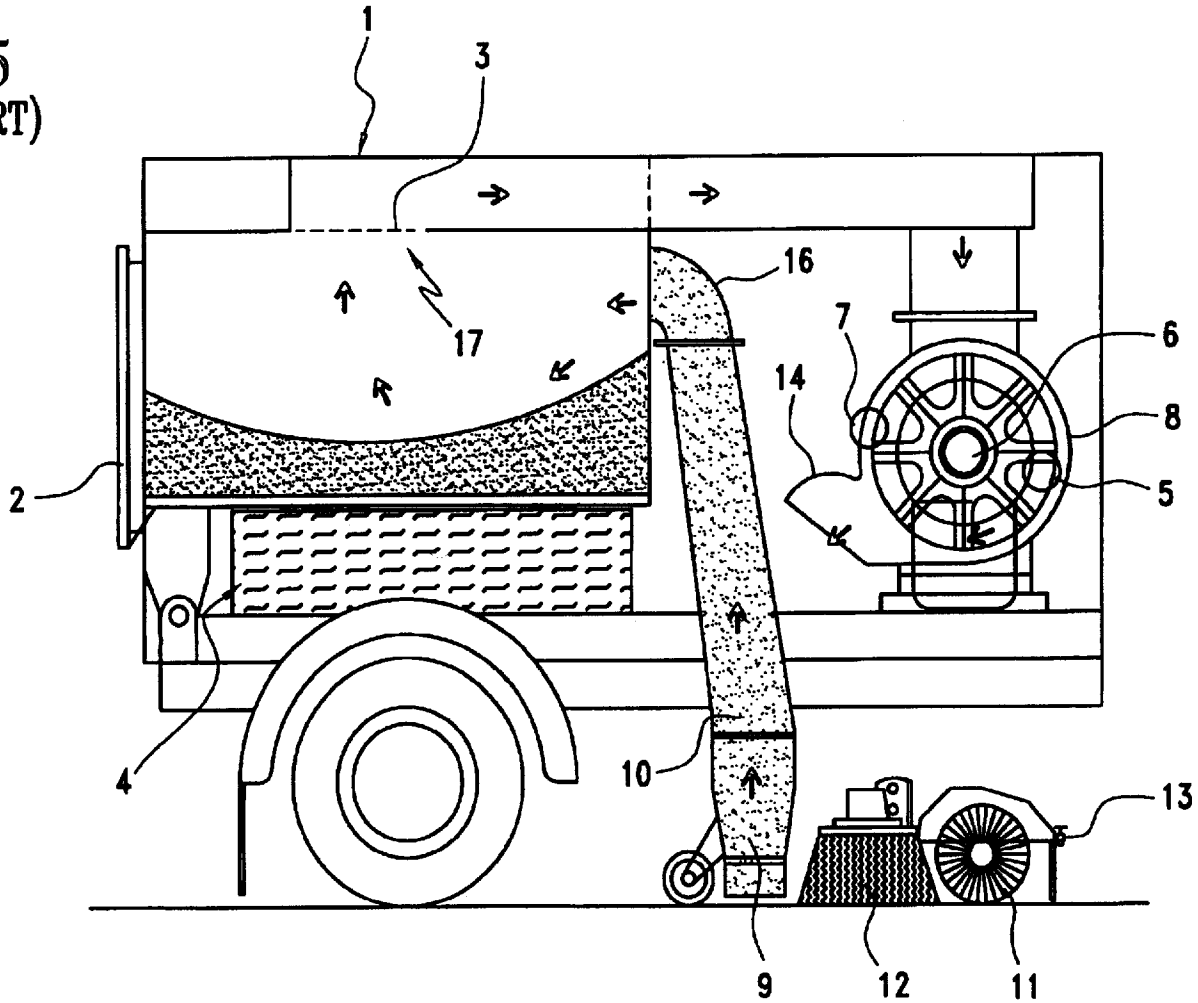
FIG. 5 (PRIOR ART)
FIG. 5 is a side view illustrating a construction of a conventional vehicle for sweeping streets.

FIG. 3 is a schematic view illustrating a structure of the filter assembly 15 which is used in the vehicle for sweeping streets according to the present invention. The filter assembly 15 comprises a plurality of water filters 20. Each water filter 20 is slidingly and removably fitted into a pair of guide rails 21 which are provided on both inner surfaces of the filter mounting section. The guide rails 21 can be formed integrally with or separately from the filter mounting section. The number of filters 20 is determined in consideration of a space defined between an upper end of the water tank 4 and the collection hopper 1.

Figure 4:
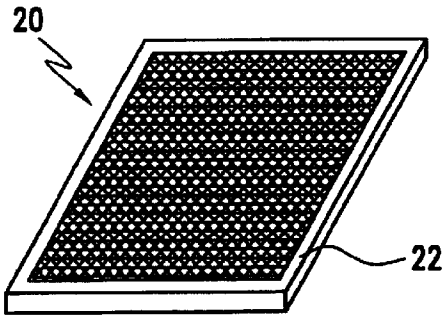
FIG. 4 is a perspective view independently illustrating a filter.

A detailed configuration of the water filter 20 is illustrated in FIG. 4.

The water filter 20 has a frame 22 which is fitted into the guide rails 21 of the filter mounting section. It is preferred that the water filter 20 is formed of a material having high corrosion resistance, such as a stainless mesh (Standard No.: #32) which is mainly used as a filter for the fiber industry and has a long useful life. Also, it is preferred that the water filter 20 has a function capable of filtering, for example, a particle of 0.479 mm.

Hereafter, operation of the vehicle for sweeping streets according to the present invention, constructed as mentioned above, will be described. As can be readily seen from FIG. 1, a blower unit 8, a hydraulic pump 7 and the water pump 5 are first driven by an auxiliary engine 6. Then, the main brush 11 and the side brush 12 are rotated, and water supplied from the water tank 4 through the water pump 5 is sprayed on the street by the water spraying nozzles 13. Refuse wetted with water is sucked through the refuse suction tube 9 and collected in the collection hopper 1. The water spraying nozzle 13 having a diameter of 1 mm is generally used. Two water spraying nozzles 13 are installed on the side brush 12, six water spraying nozzles 13 are installed on the main cylindrical brush 11, and two water spraying nozzles 13 are installed on the refuse suction duct 9.

Water sprayed on the street by the water spraying nozzles 13 wets refuse and dust existing on the street, so that dust is prevented from rising and wetted dust and refuse are sucked by the main brush 11 and the side brush 12 into the refuse suction tube 9. In this process, most of water sprayed from the water spraying nozzles 13, excluding a portion absorbed into or flowing on the street, is sucked through the refuse suction tube 9 into the collection hopper 1. As refuse wetted by water is accumulated in the collection hopper 1, water carried in the refuse can be reliably returned to the water tank 4 through the drain pipe 18 after flowing on the inclined side portions 23 and being filtered by the filtering assembly 15 to be recycled. An air stream sucked into the collection hopper 1 is discharged toward the outside through a filtering screen 3 which is centrally placed adjacent to an upper wall of the collection hopper 1.

Unexplained reference numeral 2 designates a door which is provided to a rear wall of the collection hopper 1 to allow hopper dumping operation to be implemented, 14 an air discharge opening of the blower unit 8, and 17 an air exhaust port in which the filtering screen 3 is arranged.

Figure 6:
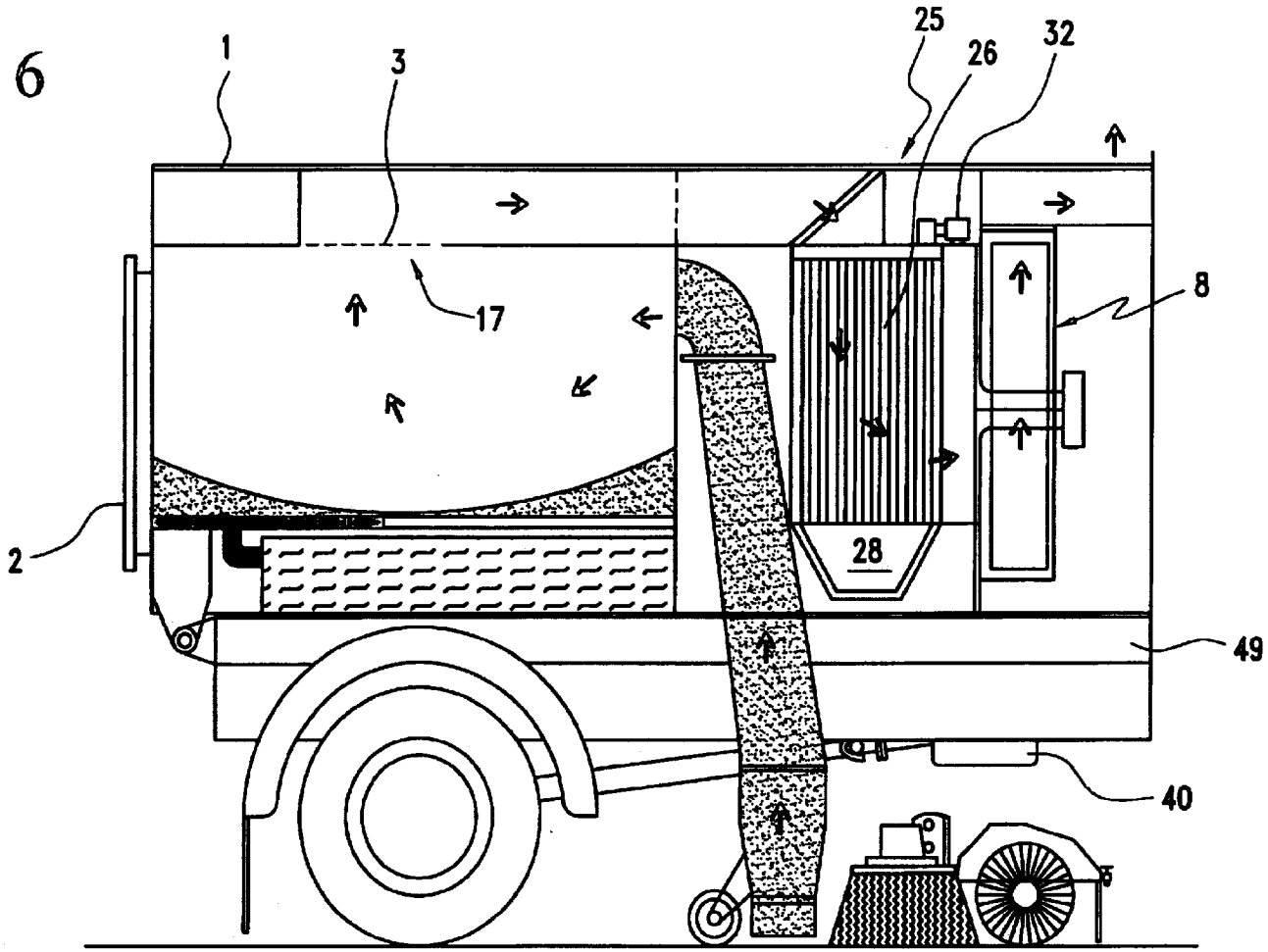
FIG. 6 is a side view illustrating a construction of a vehicle for sweeping streets having a dust collector assembly, in accordance with another embodiment of the present invention.

FIG. 6 is a side view illustrating a construction of a vehicle for sweeping streets having a dust collector assembly 25, in accordance with another embodiment of the present invention. The dust collector assembly 25 comprises a plurality of air filters 26 which are arranged side by side. The dust collector assembly 25 is disposed between the air exhaust port 17 of the collection hopper 1 and the blower unit 8.

It is preferred that the air filter 26 comprises a mesh made of stainless steel. A mesh size of the air filter 26 is determined so that only dust of no greater than 25 $\mu$m (0.0025 mm) is allowed to be discharged to the outside so as not to cause environmental pollution. In order to satisfy this prerequisite, it is preferred to use a mesh having Standard No. #550. Since the air stream sucked into the collection hopper 1 contains moisture, conventional woven fabric cannot be used as a material for the air filter 26, and therefore, it is preferred to use a mesh made of stainless steel. Since the stainless steel mesh of Standard No. #550 has a fine mesh size, environmental pollution due to dust discharge is not caused.

The dust collector assembly 25 functions to filter fine dust particles contained in the air stream which passes through the air exhaust port 17 to be discharged to the outside. The dust collector assembly 25 must be periodically or intermittently cleaned. To this end, a dust collection tray 28 is disposed below the duct collector assembly 25, and a vibrator 32 is mounted to the dust collector assembly 25. Thus, by periodically or intermittently vibrating the air filters 26, fine dust particles are removed from the air filters 26 to fall downward. These fine dust particles falling downward are collected in the dust collection tray 28. When an amount of dust particles accumulated in the dust collection tray 28 exceeds a preset level, dust dumping operation can be executed.

Figure 7A:
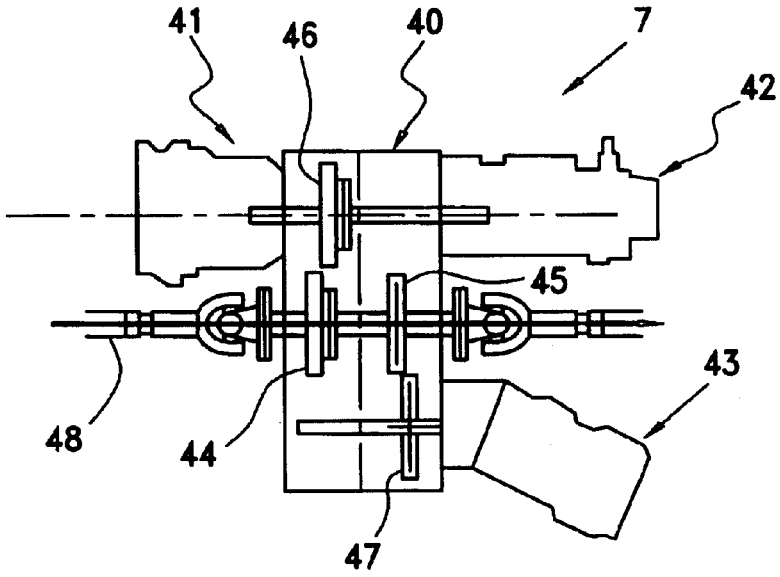
Figure 7B:
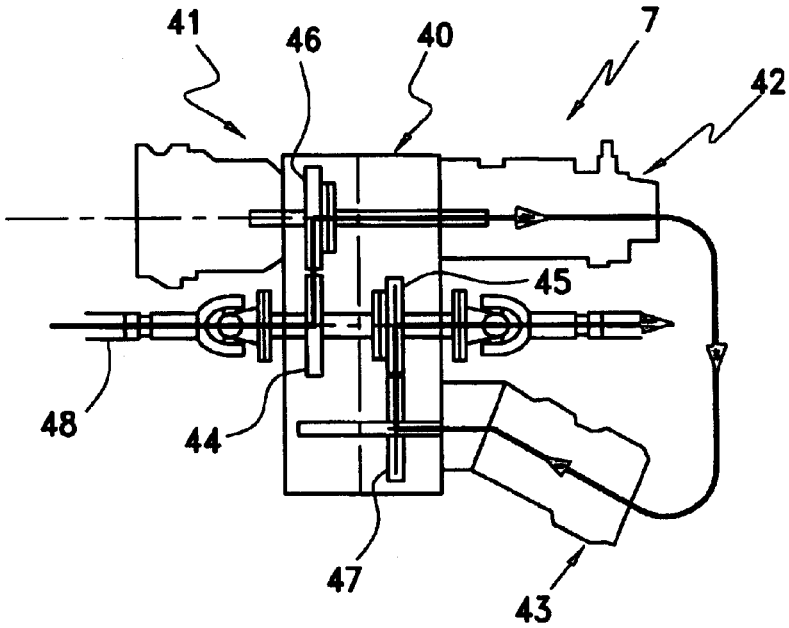

FIGS. 7*a* and 7*b* are schematic views illustrating power transmitting patterns of a hydrostatic gear box 40 which is applied to the vehicle for sweeping streets according to the present invention to serve as power distributing means. FIG. 7*a* shows a first power transmitting status wherein all of driving force generated by an engine is transmitted to a differential gear through a propeller shaft, under a non-sweeping travel condition of the vehicle for sweeping streets. FIG. 7*b* shows a second power transmitting status wherein a portion of driving force generated by the engine is transmitted to the blower unit 8 through the hydraulic pump 7 under a sweeping travel condition of the vehicle for sweeping streets. The hydrostatic gear box 40, which is mounted to a driving axle, allows power to be divisionally utilized. The hydrostatic gear box 40 allows a portion of the driving force generated by the engine to be distributed to thereby drive the hydraulic pump 7 which in turn drives the blower unit 8. In FIGS. 7*a* and 7*b*, reference numeral 41 designates a blower pump, 42 a drive pump and 43 a drive motor. In FIG. 7*a*, a gear 46 for driving the blower pump 41 and drive pump 42 and a gear 47 for driving the drive motor 43 are not meshed with gears 44 and 45, respectively, of a propeller shaft 48. The gears 44 and 45 are directly connected with each other via a clutch. Therefore, FIG. 7*a* shows the non-sweeping travel condition of the vehicle for sweeping streets, where driving force of the propeller shaft 48 does not drive the blower pump 41 and drive pump 42 and is directly transmitted to a differential system through the gear 44, the clutch and the gear 45. In FIG. 7*b*, the gear 46 for driving the blower pump 41 and drive pump 42 is meshed with the gear 44 of the propeller shaft 48, and the gear 47 for driving the drive motor 43 is meshed with the gear 45 of the propeller shaft 48. The gears 44 and 45 are disconnected from each other. Thus, FIG. 7*b* shows the sweeping travel condition of the vehicle for sweeping streets, where the driving force of the propeller shaft 48 drives the blower pump 41 and the drive pump 42 by the medium of the gears 44 and 46 meshed with each other, and then, are transmitted to the differential system through the drive motor 43 and the gears 47 and 45 meshed with each other.

In the conventional vehicle for sweeping streets, it is necessary to interrupt power transmission from the engine to the propeller shaft and thereby allow all driving force of the engine to drive the blower pump and the dive pump, or drive the auxiliary engine which is installed separately from the engine. However, in the present invention, by employing the hydrostatic gear box 40, while the vehicle for sweeping streets travels, since it is possible to transmit a portion of power to the hydraulic pump for driving the blower unit, without interruption of power transmission from the engine to the propeller shaft, the vehicle for sweeping streets can be operated with a high efficiency.

Also, because it is possible to omit the auxiliary engine for driving the hydraulic pump, a space utilization efficiency can be improved, whereby a size of the collection hopper 1 can be increased. In addition, even in the case that a size of the collection hopper 1 is not increased and the existing collection hopper 1 is used at it is, since the auxiliary engine is not required, a weight of the entire vehicle for sweeping streets can be decreased, and a manufacturing cost and fuel expenses can also be decreased. Besides, under the sweeping travel condition of the vehicle for sweeping streets, because it is not needed for the vehicle for sweeping streets to travel at a high speed, even though a portion of driving force is transmitted to the blower unit, the engine is not adversely affected.

INDUSTRIAL APPLICABILITY

As apparent from the above description, the vehicle for sweeping streets according to the present invention provides advantages in that, since a collection hopper mounted on the vehicle for sweeping streets is communicated at its bottom surface with a water tank and a filter assembly capable of filtering foreign substances included in water is arranged on the bottom surface, water carried in refuse sucked and accommodated in the collection hopper can be returned to the water tank after being filtered by the filter assembly, whereby an actual water storage capacity of the vehicle for sweeping streets can be maximized, weights of the refuse and the entire vehicle for sweeping streets can be decreased, and thereby, fuel can be saved.

Although it was illustrated and described in the preferred embodiment for facilitating understanding of the present invention that connection between the collection hopper and the water tank positioned below the collection hopper is effected by defining a water outlet hole through a bottom wall of the collection hopper and a water inlet hole through a wall of the water tank, with the water outlet and inlet holes communicated with each other by a drain pipe, a person skilled in the art will readily recognize that the collection hopper and the water tank can be connected with each other by means of a hose, or the filter assembly can be directly joined to the water tank while not requiring the drain pipe.

Further, while not shown in the drawings in detail, it can be contemplated that, in addition to both lengthwise side portions of the bottom wall of the collection hopper, a central or middle portion of the bottom wall, except a region where the filter assembly is arranged, can also be inclined downward from a front end toward a rear end thereof, to improve a drainage effect.

Also, due to the fact that the vehicle for sweeping streets according to the present invention is provided with a dust collector assembly, it is possible to prevent fine dust particles contained in air stream sucked into the collection hopper from being exhausted to the outside to cause environmental pollution.

Moreover, by the fact that a portion of driving force can be distributed to drive a blower unit while an engine is driven, because it is not necessary to switch power generated by a main engine to drive a blower unit or alternately drive an auxiliary engine, a weight of the entire vehicle for sweeping streets can be decreased, and a manufacturing cost and fuel expenses can be significantly reduced.

What is claimed is:

1. A vehicle for sweeping streets including a vehicular frame, a water tank mounted on said vehicular frame, a collection hopper located above said water tank and defined with a refuse suction port and an air exhaust port, said collection hopper delimiting a refuse accommodating space and having a filtering screen which is arranged in said air exhaust port, water spraying nozzles connected to said water tank to spray water supplied from said water tank on a street, brushes positioned close to the street to be engaged or disengaged with the street, a refuse suction tube located adjacent to said brushes to suck and convey refuse on the street through said refuse suction port into said collection hopper, and a blower unit for inducing suction force through said air exhaust port, said refuse accommodating space and said refuse suction port in said refuse suction tube, said vehicle for sweeping streets adapted for sucking and collecting refuse located on the street through said refuse suction tube into said collection hopper while water is sprayed from said water spraying nozzles to prevent fine dust particles from rising, wherein an opening is defined through a bottom wall of said collection hopper, a water inlet hole is connected to said opening through a drain pipe is defined through a wall of said water tank, and a filter assembly is arranged between said opening of said collection hopper and said water inlet hole of said water tank.

2. The vehicle for sweeping streets as set forth in claim 1, wherein the filter assembly comprises at least one water filter and is installed in a filter mounting section which is formed in said opening defined through the bottom wall of said collection hopper; and said drain pipe is arranged between said filter mounting section and said water tank.

3. The vehicle for sweeping streets as set forth in claim 2, wherein the bottom wall of said collection hopper is downwardly inclined toward said opening.

4. The vehicle for sweeping streets as set forth in claim 2, wherein a dust collector assembly for collecting fine dust particles is disposed between said air exhaust port of said collection hopper and said blower unit.

5. The vehicle for sweeping streets as set forth in claim 2, further including power distributing means for transmitting at least a portion of driving force generated by an engine, to said blower unit through a hydraulic pump.

6. The vehicle for sweeping streets as set forth in claim 1, wherein the bottom wall of said collection hopper is downwardly inclined toward said opening.

7. The vehicle for sweeping streets as set forth in claim 1, wherein a dust collector assembly for collecting fine dust particles is disposed between said air exhaust port of said collection hopper and said blower unit.

8. The vehicle for sweeping streets as set forth in claim 7, wherein said dust collector assembly for collecting fine dust particles comprises a plurality of air filters which are arranged side by side; and said vehicle for sweeping streets further includes a vibrator for periodically or intermittently vibrating the air filters to remove fine dust particles attached to the air filters and a detachable dust collection tray for collecting removed fine dust particles.

9. The vehicle for sweeping streets as set forth in claim 1, further including power distributing means for transmitting at least a portion of driving force generated by an engine, to said blower unit through a hydraulic pump.

10. The vehicle for sweeping streets as set forth in claim 9, wherein said power distributing means comprises a hydrostatic gear box.

11. The vehicle for sweeping streets as set forth in claim 9, wherein a dust collector assembly for collecting fine dust particles is disposed between said air exhaust port of said collection hopper and said blower unit.

12. The vehicle for sweeping streets as set forth in claim 11, wherein said dust collector assembly for collecting fine dust particles comprises a plurality of air filters which are arranged side by side; and said vehicle for sweeping streets further includes a vibrator for periodically or intermittently vibrating the air filters to remove fine dust particles attached to the air filters and a detachable dust collection tray for collecting removed fine dust particles.

13. The vehicle for sweeping streets as set forth in claim 12, wherein an air outlet port of said blower unit is directed toward an upper end of said collection hopper.

* * * * *